US011008740B2

(12) United States Patent
Zhao

(10) Patent No.: US 11,008,740 B2
(45) Date of Patent: May 18, 2021

(54) SHOWER FAUCET WITH ADJUSTABLE WATER INLET JOINT

(71) Applicant: Xiamen Weco Kitchen and Bath Industry Co., Ltd, Fujian (CN)

(72) Inventor: Wei-Dong Zhao, Xiamen (CN)

(73) Assignee: Xiamen Weco Kitchen and Bath Industry Co., Ltd, Fujian (CN)

( * ) Notice: Subject to any disclaimer, the term of this patent is extended or adjusted under 35 U.S.C. 154(b) by 0 days.

(21) Appl. No.: 16/676,765

(22) Filed: Nov. 7, 2019

(65) Prior Publication Data

US 2020/0149255 A1 May 14, 2020

(30) Foreign Application Priority Data

Nov. 9, 2018 (CN) ..... 201821844065.4

(51) Int. Cl.
*E03C 1/06* (2006.01)

(52) U.S. Cl.
CPC ..... *E03C 1/063* (2013.01)

(58) Field of Classification Search
CPC ..... E03D 1/066; E03C 1/06; E03C 1/063
See application file for complete search history.

(56) References Cited

U.S. PATENT DOCUMENTS 9,068,325 B2 * 6/2015 Neagoe ..... E03C 1/0408
2018/0347160 A1 * 12/2018 Wilson ..... E03C 1/025

OTHER PUBLICATIONS

"Mirabelle Installation Sheet"; www.mirabelleproducts.com; 2017 Ferguson Enterprises, Inc. 253537 Aug. 2016.
"Moen Installation".
"Traditional Installation" Installation Instructions.

* cited by examiner

*Primary Examiner* — Christine J Skubinna
(74) *Attorney, Agent, or Firm* — J.H. Lin Patent Law P.C.; John H. Lin

(57) ABSTRACT

A shower faucet with an adjustable water inlet joint is provided. The shower faucet includes an outer pipe, an inner pipe, and the adjustable water inlet joint to provide water to the inner pipe from a wall pipe. The adjustable water inlet joint comprises a threaded through hole and a telescopic connecting pipe. The telescopic connecting pipe comprises a first threaded end and a second threaded end, the first threaded end for screwing the telescopic connecting pipe in or out of the threaded through hole to adjust a length of the telescopic connecting pipe extending beyond the threaded through hole, and the second threaded end for screwing the telescopic connecting pipe into the wall pipe.

6 Claims, 5 Drawing Sheets

SHOWER FAUCET WITH ADJUSTABLE WATER INLET JOINT

CROSS-REFERENCE TO RELATED APPLICATION

This non-provisional application claims priority under 35 U.S.C. § 119(a) to Chinese Patent Application No. 201821844065.4, filed on Nov. 9, 2018. The content of which are hereby incorporated by reference.

BACKGROUND

Technical Field

The present disclosure generally relates to bathroom or kitchen hardware.

Description of the Related Arts

For the sake of safety and beauty, the water pipes in the bathroom are generally pre-embedded in the wall. When installing a shower faucet, a water inlet connector is normally used to connect the pre-embedded water pipes (also referred to as wall pipes) to receive water for the shower faucet.

SUMMARY

Some embodiments of the disclosure provide a shower faucet with an adjustable water inlet joint. A shower faucet includes an outer pipe, an inner pipe, and the adjustable water inlet joint installed on the outer pipe to provide water to the inner pipe from a wall pipe. The adjustable water inlet joint comprises a threaded through hole and a telescopic connecting pipe. The telescopic connecting pipe comprises a first threaded end and a second threaded end, the first threaded end for screwing the telescopic connecting pipe in or out of the threaded through hole to adjust a length of the telescopic connecting pipe extending beyond the threaded through hole, and the second threaded end for screwing the telescopic connecting pipe into the wall pipe.

The preceding Summary is intended to serve as a brief introduction to some embodiments of the disclosure. It is not meant to be an introduction or overview of all inventive subject matter disclosed in this document. The Detailed Description that follows and the Drawings that are referred to in the Detailed Description will further describe the embodiments described in the Summary as well as other embodiments. Accordingly, to understand all the embodiments described by this document, a Summary, Detailed Description and the Drawings are provided. Moreover, the claimed subject matter is not to be limited by the illustrative details in the Summary, Detailed Description, and the Drawings, but rather is to be defined by the appended claims, because the claimed subject matter can be embodied in other specific forms without departing from the spirit of the subject matter.

BRIEF DESCRIPTION OF THE DRAWINGS

The drawings are of illustrative embodiments. They do not illustrate all embodiments. Other embodiments may be used in addition or instead. Details that may be apparent or unnecessary may be omitted to save space or for more effective illustration. Some embodiments may be practiced with additional components or steps and/or without all of the components or steps that are illustrated. When the same numeral appears in different drawings, it refers to the same or like components or steps.

DETAILED DESCRIPTION

In the following detailed description, numerous specific details are set forth by way of examples in order to provide a thorough understanding of the relevant teachings. However, it should be apparent that the present teachings may be practiced without such details. In other instances, well-known methods, procedures, components, and/or circuitry have been described at a relatively high-level, without detail, in order to avoid unnecessarily obscuring aspects of the present teachings.

When installing an existing shower faucet to connect to a water pipe buried in the wall (also referred to as a wall pipe), the length of the water inlet joint is fixed, while the bury depth of the wall pipe is generally unknown in advance. If the length of the water inlet joint is less than the bury depth of the wall pipe, the shower faucet cannot be installed. If the length of the water inlet joint is greater than the depth of the wall pipe, the installed shower faucet will be too far separated from the wall. Therefore, during installation, water inlet joints of different lengths have to be tried until one that matches the depth of the wall pipe is found. In order to solve the problem of the bury depth of the wall pipe mismatching the length of the water inlet joint, some embodiments of the disclosure provide a shower faucet with an adjustable water inlet joint.

Figure 1:
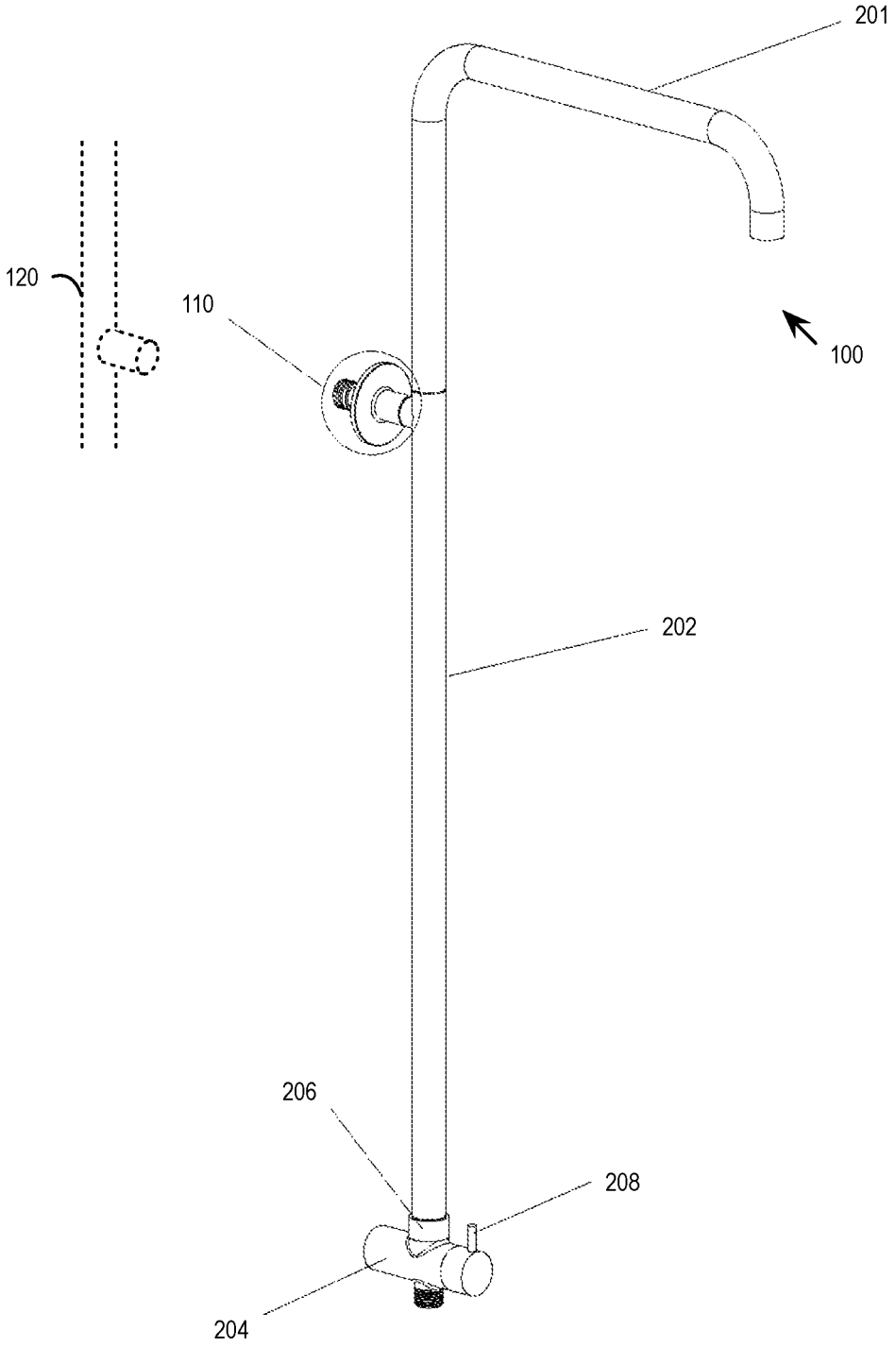
FIG. 1 illustrates a shower faucet with an adjustable water inlet joint, consistent with an exemplary embodiment.
Figure 2:
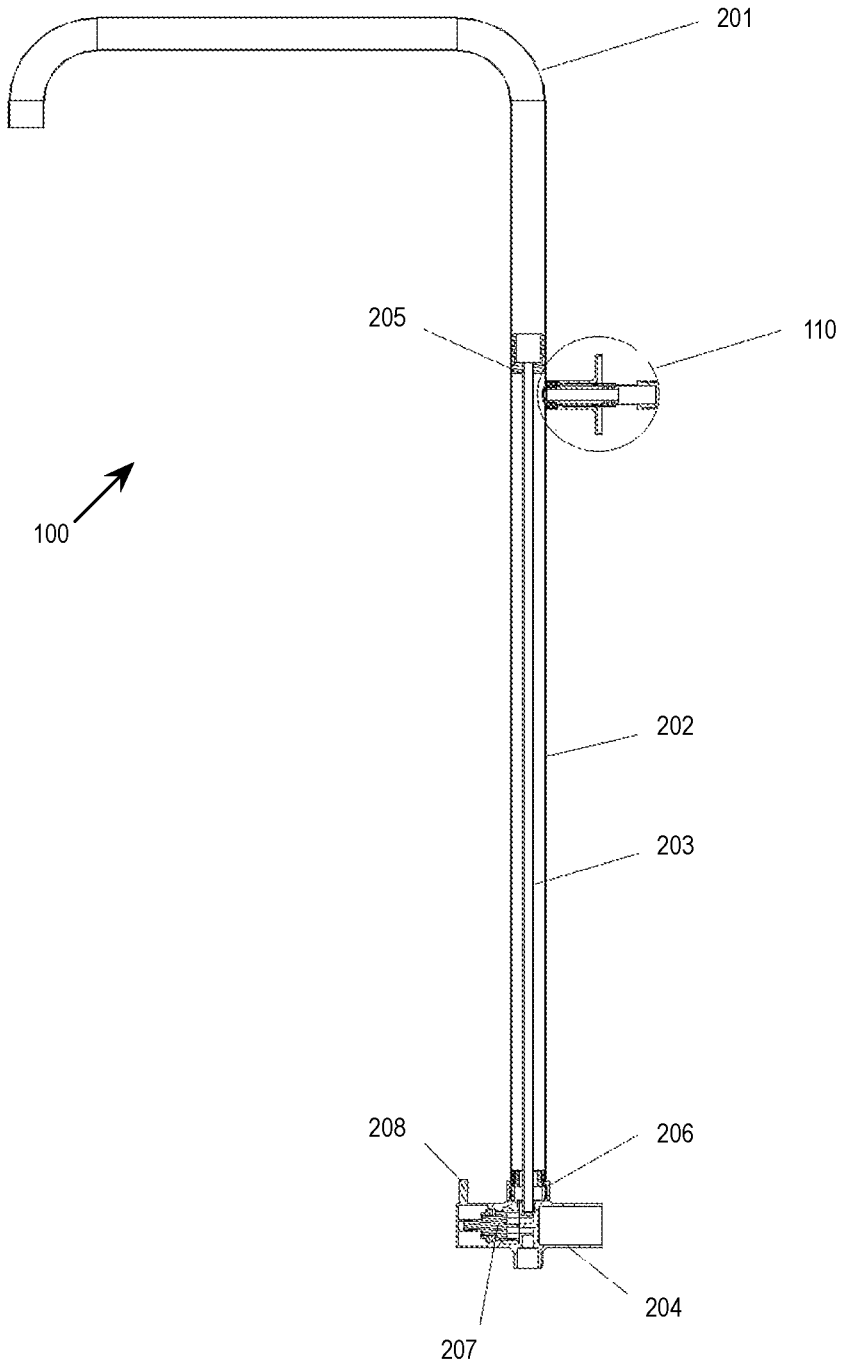
FIG. 2 illustrates a cross-section view of the shower faucet.

FIG. 1 illustrates a shower faucet 100 with an adjustable water inlet joint 110 for installation onto a wall pipe 120, consistent with an exemplary embodiment. FIG. 2 illustrates a cross-section view of the shower faucet 100. As illustrated, the shower faucet 100 includes a water outlet pipe 201, an outer pipe 202, an inner pipe 203, a valve seat 204, and a water inlet joint 110. One end of the outer pipe 202 is connected with the water outlet pipe 201 through a connecting head 205, and the other end of the outer pipe 202 is connected with the valve seat 204 through a mounting nut 206. The inner pipe 203 is installed within the outer pipe 202, one end of the inner pipe 203 passes through the connecting head 205 and the other end of the inner pipe 203 passes through the mounting nut 206. The water inlet joint 110 is installed on the outer pipe 202 to provide water to the inner pipe 203 from the wall pipe 120. A valve core 207 is installed within the valve seat 204, and a bolt shaft of the valve core 207 is connected with a handle 208.

Figure 3:
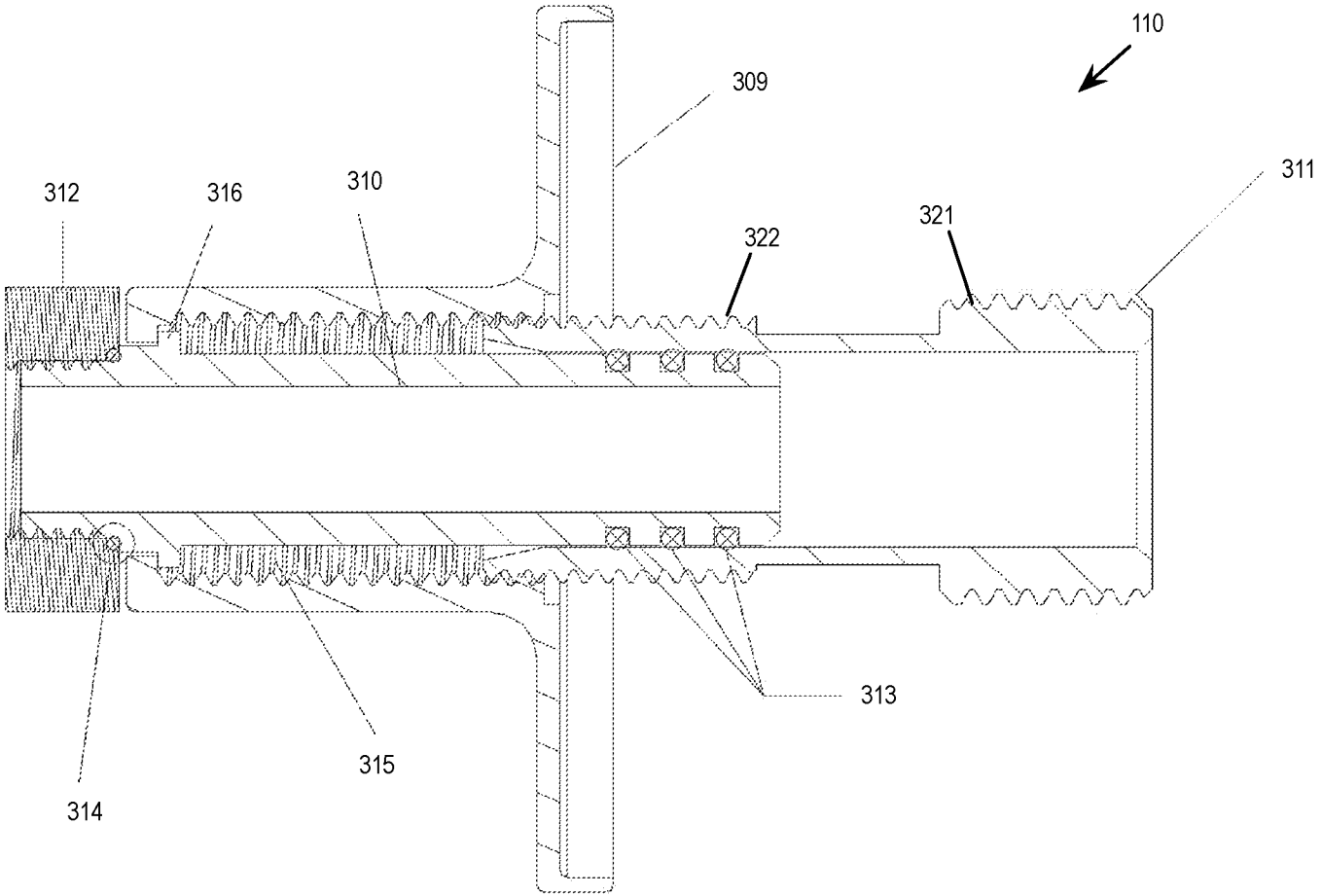
FIG. 3 illustrates a cross-section view of the water inlet joint.

FIG. 3 illustrates a cross-section view of the water inlet joint. As illustrated, the adjustable water inlet joint 110 includes a decorative seat 309, a fixed connecting pipe 310 and a telescopic connecting pipe 311. The middle of the decorative seat 309 is provided with a threaded through hole 315. One end of the fixed connecting pipe 310 has a threaded section, and one end of the threaded section has a flange 316. The telescopic connecting pipe 311 includes a first threaded end 321 and a second threaded end 322. The telescopic connecting pipe 311 is screwed into the threaded through hole 315 from the bottom of the decorative seat 309 in a threaded matching manner. The fixed connecting pipe 310 is fixed in the threaded through hole 315, the threaded end of the fixed connecting pipe 310 extends out of the threaded through hole 315 and is locked by a fixed nut 312, and the other end of the fixed connecting pipe 310 extends into the telescopic connecting pipe 311. The one end of the fixed connecting pipe 310 extending into the telescopic connecting pipe 311 has a groove, and a first O-ring (O-ring I) 313 is installed in the groove. A gap between the fixed connecting pipe 310 and the fixed nut 312 is filled with a second O-ring (O-ring II) 314.

When installing the shower faucet 100 with the adjustable water inlet joint 110 onto a wall pipe, the telescopic connecting pipe 311 can be screwed in or out along the threaded through hole 315, the length of the telescopic connecting pipe 311 exposed outside the threaded through hole 315 can be adjusted to match the depth of the wall pipe 120 inside the wall. The wall pipe may then be connected through the threads on the telescopic connecting pipe 311.

Since the telescopic connecting pipe 311 of the adjustable water inlet joint can be screwed in or out of the threaded through hole 315 on the decorative seat 309, the length of the telescopic connecting pipe 311 exposed outside the threaded through hole 315 can be adjusted to match the bury depth of the wall pipe. The shower faucet with the adjustable water inlet joint can therefore be easily installed, regardless of the bury depth of the wall pipe. Thus, the time and effort required to install a shower faucet can be greatly reduced.

Figure 4:
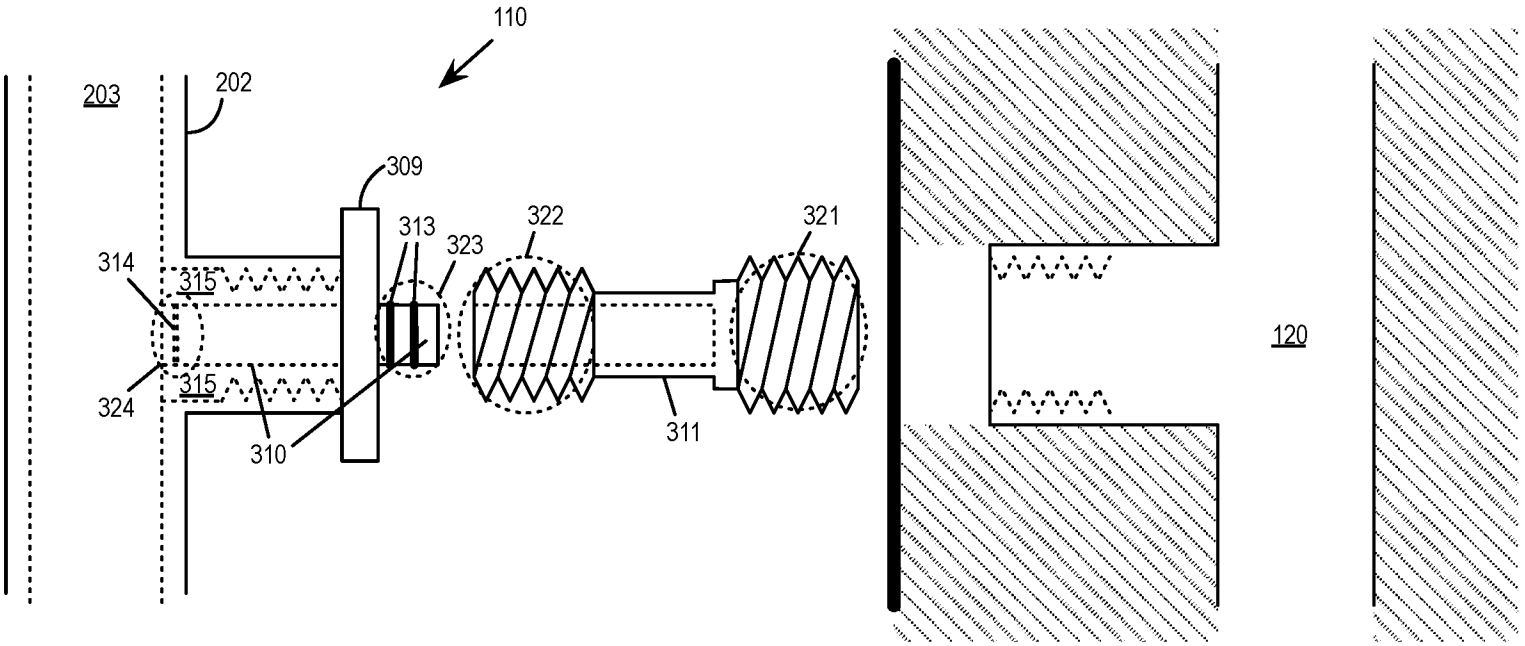
FIG. 4 illustrates an exploded view of the adjustable water inlet joint for the shower faucet.

FIG. 4 illustrates an exploded view of the adjustable water inlet joint for the shower faucet 100, consistent with an exemplary embodiment. As illustrated, the shower faucet 100 includes the outer pipe 202, the inner pipe 203, and the adjustable water inlet joint 110 installed on the outer pipe 202 to provide water to the inner pipe 203 from the wall pipe 120. The adjustable water inlet joint 110 includes the threaded through hole 315 and the telescopic connecting pipe 311. The telescopic connecting pipe 311 includes a first threaded end 321 and a second threaded end 322. The second threaded end 322 is for screwing the telescopic connecting pipe in or out of the threaded through hole 315, and the first threaded end 321 is for screwing the telescopic connecting pipe 311 into the wall pipe 120.

The adjustable water inlet joint 110 further includes the fixed connecting pipe 310 that is fixed in the threaded through hole 315. The fixed connecting pipe 310 includes a first end 323 and a second end 324. The first end of the fixed connecting pipe may extend into the telescopic connecting pipe 311. The first end 323 has a groove that is installed with the first O-rings 313 for fitting the fixed connecting pipe 310 into the telescopic connecting pipe 311 to prevent water leakage. The second end 324 has the second O-ring 314 for fitting the fixed connecting pipe 310 into the inner pipe 203. The first end 323 of the fixed connecting pipe 310 is not threaded. The second end 324 of the fixed connecting pipe 310 includes a threaded section and the flange 316 (not illustrated in FIG. 4 for visual clarity), the second end 324 of the fixed connecting pipe 310 extending out of the threaded through hole 315 and is locked to the outer pipe 202 by the threaded fixed nut 312 (not illustrated in FIG. 4 for visual clarity). The second O-ring 314 fills a gap between the fixed connecting pipe and the fixed nut 312. The shower faucet further includes the decorative seat 309 such that the threaded through hole 315 is built into the decorative seat 309.

Figure 5A:
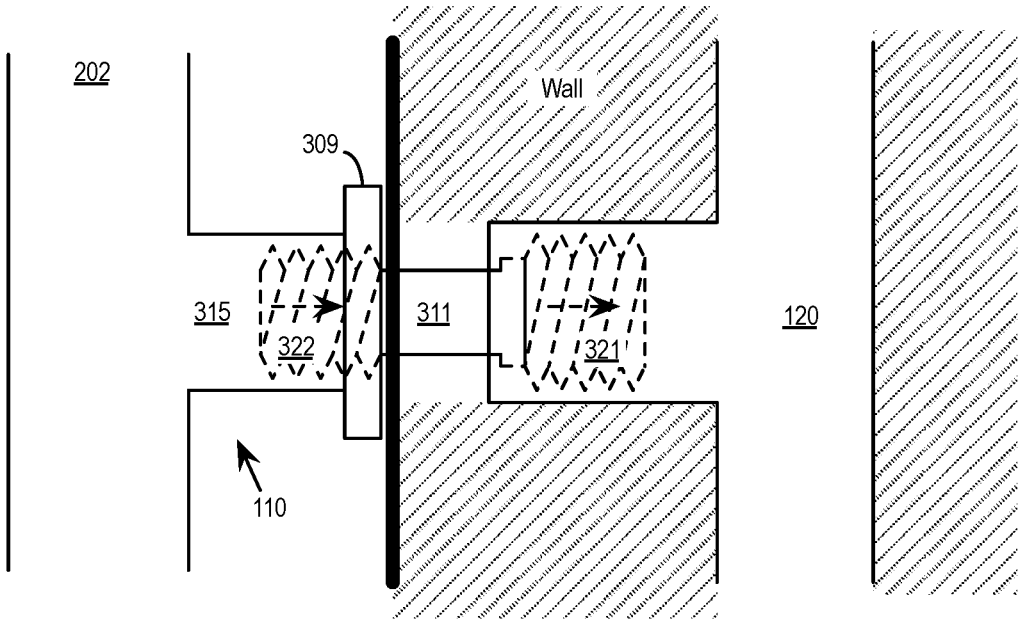
FIGS. 5*a* and 5*b* illustrates using the telescopic connecting pipe of the adjustable water inlet joint to match different bury depths of wall pipes.
Figure 5B:
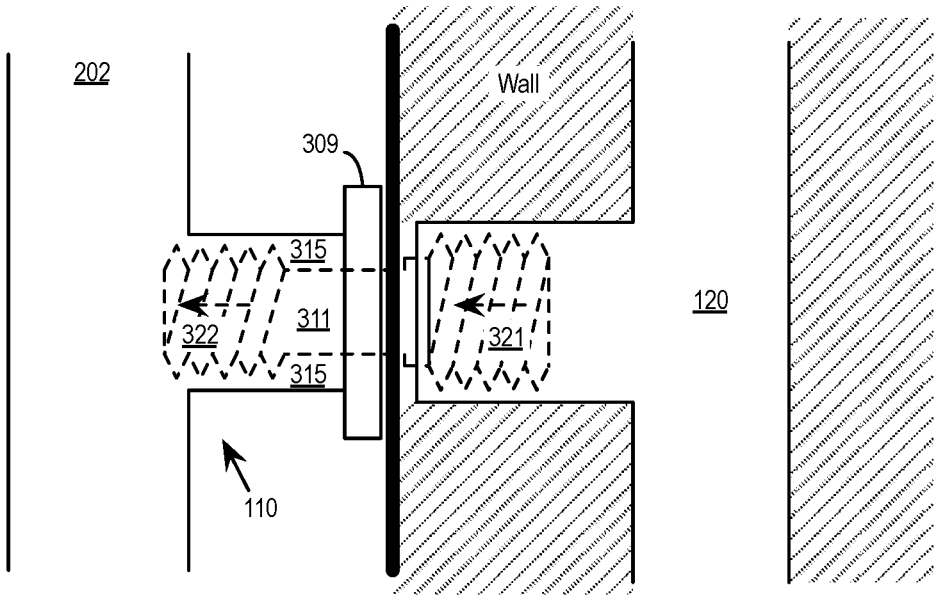

A user may adjust a length of the telescopic connecting pipe 311 to extend beyond the threaded through hole 315 to match the bury depth of the wall pipe 120 by screwing the telescopic connecting pipe 311 in or out of the threaded through hole 315. FIGS. 5A and 5B illustrates using the telescopic connecting pipe 311 of the adjustable water inlet joint to match different bury depths of wall pipes.

FIG. 5A shows the adjustable water inlet joint 110 being used to install the shower faucet 100 onto to the wall pipe 120 when the wall pipe is buried deep in the wall. As illustrated, the position of the telescopic connecting pipe 311 is adjusted to provide the additional length necessary to reach the deeply buried wall pipe 120 to receive water.

FIG. 5B shows the adjustable water inlet joint 110 being used to install the shower faucet 100 onto to the wall pipe 120 when the wall pipe is not buried as deeply as in FIG. 5B. As illustrated, the position of the telescopic connecting pipe 311 is adjusted so not to extend too far beyond the threaded through hole 315. This allows the shower faucet 100 assembly (specifically the decorative seat 309) to remain neatly seated on the wall with minimal separation.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A shower faucet comprising:

an outer pipe, an inner pipe installed within the outer pipe, and an adjustable water inlet joint installed on the outer pipe to provide water to the inner pipe from a wall pipe, wherein the adjustable water inlet joint comprises a threaded through hole and a telescopic connecting pipe, wherein the telescopic connecting pipe comprises a first threaded end and a second threaded end, the first threaded end for screwing the telescopic connecting pipe in or out of the threaded through hole to adjust a length of the telescopic connecting pipe extending beyond the threaded through hole, and the second threaded end for screwing the telescopic connecting pipe into the wall pipe.

2. The shower faucet of claim 1, wherein the adjustable water inlet joint further comprises a fixed connecting pipe that is fixed in the threaded through hole, wherein the fixed connecting pipe comprises a first end and a second end, the first end having a groove that is installed with a first O-ring for fitting the fixed connecting pipe into the telescopic connecting pipe, the second end having a second O-ring for fitting the fixed connecting pipe into the inner pipe.

3. The shower faucet of claim 2, wherein the first end of the fixed connecting pipe is not threaded, the first end of the fixed connecting pipe extending into the telescopic connecting pipe, wherein the second end of the fixed connecting pipe comprises a threaded section and a flange, the second end of the fixed connecting pipe extending out of the threaded through hole and is locked to the outer pipe by a threaded fixed nut.

4. The shower faucet of claim 3, wherein the second O-ring fills a gap between the fixed connecting pipe and the threaded fixed nut.

5. The shower faucet of claim 1 further comprises a decorative seat that comprises the threaded through hole.

6. The shower faucet of claim 1, wherein one end of the outer pipe is connected with a water outlet pipe through a connecting head, and another end of the outer pipe is connected with a valve seat through a mounting nut, wherein one end of the inner pipe passes through the connecting head and another end of the inner pipe passes through the mounting nut, wherein a valve core is installed within the valve seat, and a bolt shaft of the valve core is connected with a handle.

* * * * *